US011199191B2

(12) United States Patent
Jang et al.

(10) Patent No.: US 11,199,191 B2
(45) Date of Patent: Dec. 14, 2021

(54) ELECTRIC WATER PUMP AND MANUFACTURING METHOD FOR THEREOF

(71) Applicant: COAVIS, Sejong-si (KR)

(72) Inventors: Young Sub Jang, Sejong-si (KR); Joon Seop Kim, Daejeon (KR); Wan Sung Pae, Sejong-si (KR)

(73) Assignee: COAVIS, Sejong-si (KR)

( * ) Notice: Subject to any disclaimer, the term of this patent is extended or adjusted under 35 U.S.C. 154(b) by 739 days.

(21) Appl. No.: 16/033,053

(22) Filed: Jul. 11, 2018

(65) Prior Publication Data

US 2019/0017510 A1 Jan. 17, 2019

(30) Foreign Application Priority Data

Jul. 12, 2017 (KR) ..... 10-2017-0088390

(51) Int. Cl.

| | |
|---|---|
| ***F04D 13/06*** | (2006.01) |
| ***F04D 25/06*** | (2006.01) |
| ***F04D 29/58*** | (2006.01) |
| *F04D 29/62* | (2006.01) |

(52) U.S. Cl.

CPC ..... *F04D 13/06* (2013.01); *F04D 25/068* (2013.01); *F04D 29/5806* (2013.01); *F04D 13/0606* (2013.01); *F04D 29/58* (2013.01); *F04D 29/628* (2013.01)

(58) Field of Classification Search

CPC ..... F04D 13/02; F04D 13/06; F04D 13/0606; F04D 25/02; F04D 25/06; F04D 25/0606; F04D 25/066; F04D 25/068; F04D 25/0693; F04D 29/02; F04D 29/026; F04D 29/40; F04D 29/58; F04D 29/5806; F04D 29/5813; F04D 29/586; F04D 29/5866; F04D 29/60; F04D 29/62; F04D 29/628; F04D 29/605; F01P 5/10; F01P 5/12; F01P 2005/125; H01G 9/004; H01G 9/08; H01G 9/10; H02K 5/22; H02K 5/225; H02K 11/30; H02K 11/33

USPC ..... 310/71; 29/596; 417/421, 422, 423.14

See application file for complete search history.

(56) References Cited

FOREIGN PATENT DOCUMENTS

| | | | | |
|---|---|---|---|---|
| JP | 2006257912 A | | 9/2006 | |
| JP | 2012092742 | * | 5/2012 | ..... F04D 13/00 |
| JP | 2012092742 A | | 5/2012 | |
| KR | 101332853 B1 | | 11/2013 | |

* cited by examiner

*Primary Examiner* — Alex Torres-Rivera
*Assistant Examiner* — David A. Singh
(74) *Attorney, Agent, or Firm* — McCoy Russell LLP

(57) ABSTRACT

An electric water pump of which productivity, maintainability, and use convenience may be improved by simplifying a production process through a change in a structure, and a method of manufacturing the same. The electric water pump includes: a pump housing accepting a motor therein; an acceptor having a cylindrical shape of which one side is opened and formed at one side of the pump housing; a control substrate installed in the acceptor; an external terminal formed of a conductor and penetrating through the acceptor to electrically connect the control substrate to an external power supply; and an internal terminal formed of a conductor and penetrating through the pump housing and the acceptor to electrically connect the motor and the control substrate to each other.

7 Claims, 6 Drawing Sheets

*Prior art*

ELECTRIC WATER PUMP AND MANUFACTURING METHOD FOR THEREOF

CROSS-REFERENCE TO RELATED APPLICATION

This application claims priority under 35 U.S.C. § 119 to Korean Patent Application No. 10-2017-0088390, filed on Jul. 12, 2017, in the Korean Intellectual Property Office, the disclosure of which is incorporated herein by reference in its entirety for all purposes.

TECHNICAL FIELD

The following disclosure relates to an electric water pump and a method of manufacturing the same, and more particularly, to an electric water pump of which productivity, maintainability, and use convenience may be improved by simplifying a production process through a change in a structure, and a method of manufacturing the same.

BACKGROUND

An electric water pump (EWP), which is a pump driven by a motor controlled by a separate apparatus, is mainly used to circulate a coolant. The electric water pump may determine a flow rate of the coolant regardless of a rotational speed of the engine, may decrease required power of 60 to 70% as compared with a mechanical water pump, and is simple in terms of a structure since it is driven by the motor rather than a belt. Therefore, the electric water pump has been recently used widely in a vehicle.

In the related art, Korean Patent Publication No. 10-1332853 (entitled "Electric Water Pump with Cooling Unit for Vehicles", published on Nov. 27, 2013, and hereinafter referred as Related Art 1) discloses the electric water pump. FIG. 1 is one of the drawings of Related Art 1, and a structure of the electric water pump according to the related art is described with reference to FIG. 1.

As illustrated in FIG. 1, in the electric water pump according to the related art, a motor body 20 is installed in a pump case 10. The motor body 20 discharges a fluid from an inlet 30 to an outlet 40 while rotating a shaft 50 and an impeller connected to the shaft. The motor body 20 is electrically connected to a control substrate 60 formed at one side of the pump through an internal terminal 80, and is controlled through a control circuit printed on the control substrate 60.

The electric water pump illustrated in FIG. 1 should receive power supplied from a separate external power supply. In general, an external terminal formed of a conductor is installed in a cover 70 installed to accept the control substrate 60 therein so as to penetrate through the cover 70, both ends of the external terminal are connected to the control substrate and the external power supply, respectively, and the control substrate and a motor are connected to the internal terminal to supply the power from the external power supply to the motor. In the configuration according to the related art described above, each of the external terminal penetrating through the cover and the internal terminal should be manufactured through insert-injection-molding. However, in such a manufacturing manner, the insert-injection-molding should be performed twice, such that a manufacturing process is not easy and economical efficiency is thus low.

In addition, since the external terminal penetrates through the cover to connect the control substrate and the motor to each other, foreign material may be introduced into a gap between the external terminal and the cover, and when debugging or repair is performed on the control substrate, the debugging or maintenance should be performed after releasing electrical connection between the external power supply, the external terminal, and the control substrate and removing the cover, and it is thus inconvenient for a user to perform such a work.

i. Korean Patent Publication No. 10-1332853 (entitled "Electric Water Pump with Cooling Unit for Vehicles", published on Nov. 27, 2013)

SUMMARY

An embodiment of the present disclosure is directed to providing an electric water pump capable of being easily manufactured, being economical, and facilitating maintenance of a control substrate controlling the electric water pump by simplifying a manufacturing process through a structural change of an external terminal and an internal terminal installed in the electric water pump, and a method of manufacturing the same.

In one general aspect, an electric water pump includes: a pump housing accepting a motor therein; an acceptor having a cylindrical shape of which one side is opened and formed at one side of the pump housing; a control substrate installed in the acceptor; an external terminal formed of a conductor and penetrating through the acceptor to electrically connect the control substrate to an external power supply; and an internal terminal formed of a conductor and penetrating through the pump housing and the acceptor to electrically connect the motor and the control substrate to each other.

The electric water pump may further include a heat transfer portion installed between the control substrate and the pump housing.

The electric water pump may further include a cover installed at one side of the acceptor so as to cover the control substrate.

The acceptor, the external terminal, and the internal terminal may be manufactured through insert-injection-molding.

In another general aspect, a method of manufacturing an electric water pump includes: a previous manufacturing step of manufacturing a pump housing and an acceptor, the acceptor being manufactured so that an external terminal and an internal terminal penetrate through the acceptor and one ends of the external terminal and the internal terminal are positioned at an outer portion of the acceptor and the other ends thereof are positioned at an inner portion of the acceptor; an assembling step of installing components of the electric water pump including a motor in the pump housing, assembling the acceptor to one side of the pump housing, and connecting one end of the internal terminal to the motor; a control substrate installing step of installing a control substrate in the acceptor; and a cover installing step of installing a cover so as to cover the control substrate.

In the control substrate installing step, the control substrate may be installed after a heat transfer portion is installed at one side of the acceptor.

In the control substrate installing step, the control substrate may be installed using press fitting.

In the control substrate installing step, after the control substrate is installed, the control substrate may be screwed so that one end portion of a bolt penetrates through the control substrate and is in contact with the pump housing, and the bolt and a ground of the control substrate may be connected to each other.

DETAILED DESCRIPTION

Hereinafter, an electric water pump according to an exemplary embodiment of the present disclosure will be described in detail with reference to the accompanying drawings.

Figure 1:
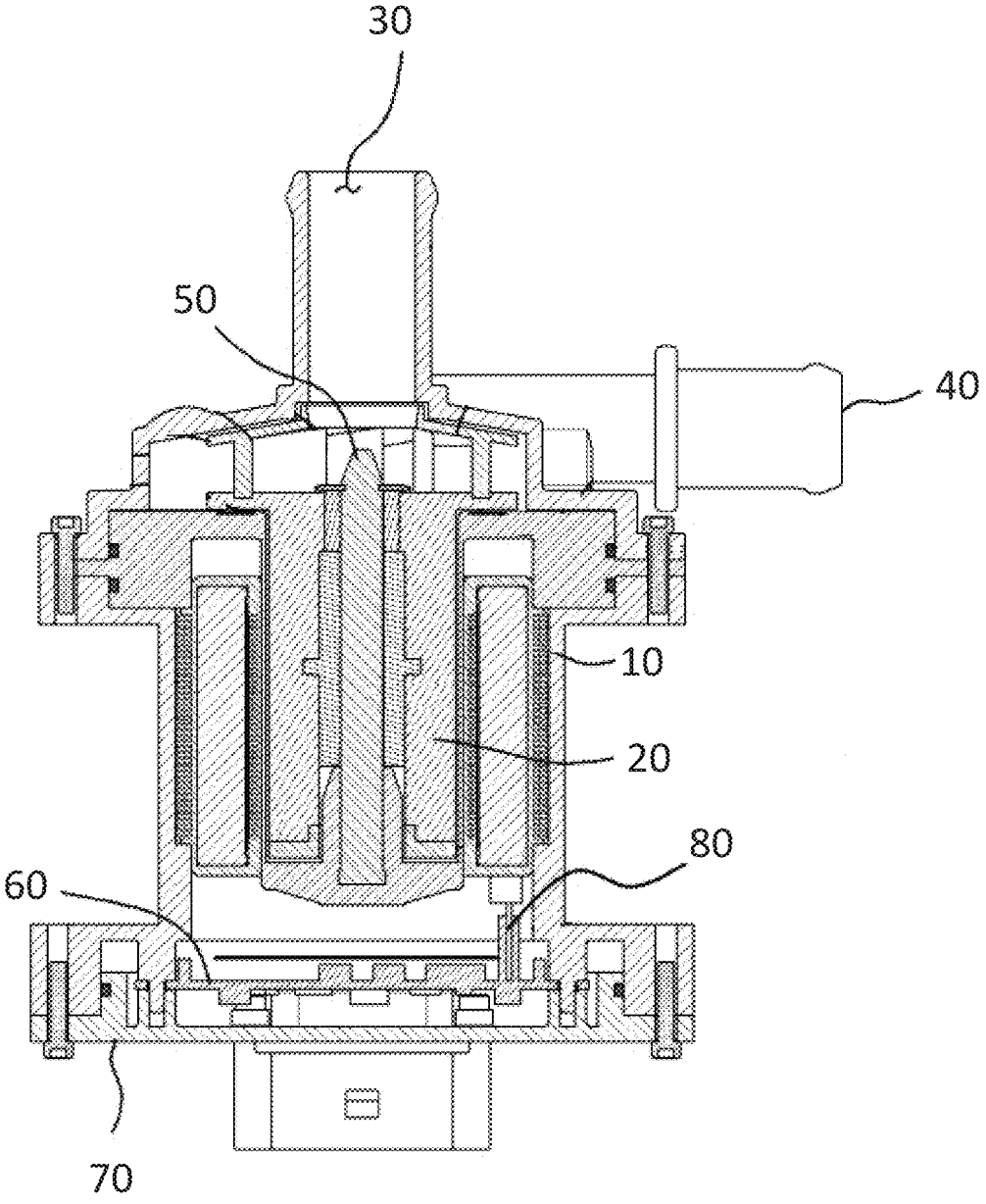
FIG. 1 is a cross-sectional view of an electric water pump according to the related art.
Figure 2:
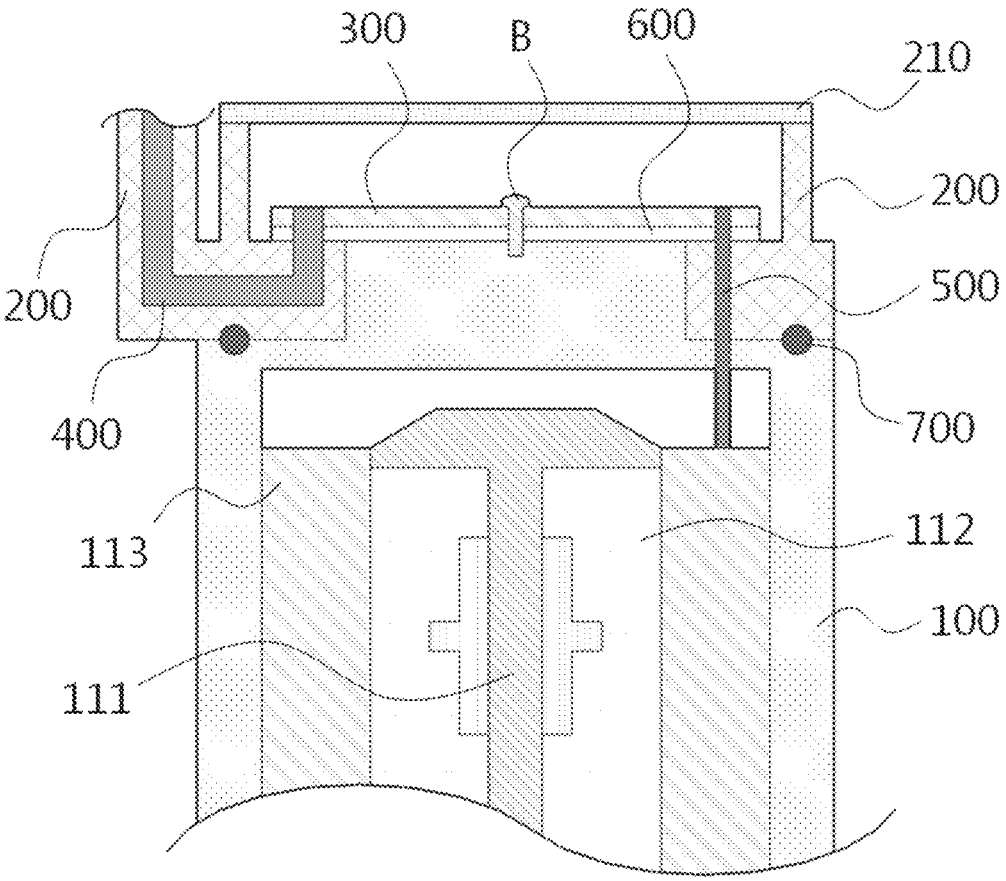
FIG. 2 is a cross-sectional view of an electric water pump according to the present disclosure.

FIG. 2 is a cross-sectional view of an electric water pump according to an exemplary embodiment of the present disclosure. In FIG. 2, only a portion of the electric water pump is illustrated in order to describe characteristics of the present disclosure. As illustrated in FIG. 2, the electric water pump according to an embodiment of the present disclosure may include a pump housing 100, an acceptor 200, a control substrate 300, an external terminal 400, and an internal terminal 500.

The pump housing 100, which is a kind of case, may accept components required for driving the electric water pump, including a motor, therein. An example of the components accepted in the pump housing 100 may include the motor, a shaft 111, and an impeller (not illustrated).

The motor may include a stator 113 and a rotor 112 illustrated in FIG. 2. The stator 113 has a current flowing therein, and generates a magnetic field through a change in the current to rotate the rotor 112. Therefore, power and a control signal need to be applied to the stator 113. The shaft 111 rotates together with the rotor 112 depending on the rotation of the rotor 112, and the impeller is coupled to one end portion of the shaft 111 and serves to introduce and discharge a fluid.

As illustrated in FIG. 2, the acceptor 200, which is a component formed at one side of the pump housing, is formed at an upper side of the pump housing 100 in FIG. 2. The acceptor 200 may be formed through injection-molding, and may be formed together with an external terminal 400 and an internal terminal 500 to be described below through insert-injection-molding.

The acceptor 200 has a cylindrical shape of which upper and lower portions are opened, and is fitted and assembled into the upper side of the pump housing 100. The acceptor 200 is fitted into a protruding portion of an upper portion of the pump housing 100, and when the pump housing 100 and the acceptor 200 are coupled to each other, an O-ring 700 may be fitted between surfaces of the pump housing 100 and the acceptor 200 in contact with each other. Since the acceptor 200 has the cylindrical shape, when the acceptor 200 is fitted onto the pump housing 100, an upper surface of the pump housing 100 is exposed to an inner portion of the acceptor 200.

The control substrate 300 is fitted into a central portion of the acceptor 200 and is installed on the exposed upper surface of the pump housing 100, and a heat transfer portion 600 may be installed between the control substrate 300 and the pump housing 100. The heat transfer portion 600 may be formed of a material such as silicon having high thermal conductivity, and serves as a kind of passage discharging heat generated from the control substrate 300 to the outside.

The heat discharged through the heat transfer portion 600 is transferred to the pump housing 100, and the pump housing 100 may also be formed of a material such as aluminum having high thermal conductivity to serve as a kind of heat sink absorbing and dissipating the heat generated from the control substrate 300, thereby preventing a malfunction and a fault of the control substrate 300.

The control substrate 300 is a kind of printed circuit board (PCB) on which a circuit is printed in order to supply power to the electric water pump according to the present disclosure and control the electric water pump according to the present disclosure, and may be electrically connected to the motor, more specifically, the stator 113 included in the motor to control the power applied to the stator 113, thereby adjusting a rotation level of the rotor 112 and the shaft 111.

As illustrated in FIG. 2, the external terminal 400 penetrates through a side surface of the acceptor 200 and is used as a transfer passage of the power or the control signal applied to the control substrate. The middle of the external terminal 400 is buried in the acceptor 200, and both sides of the external terminal 400 are positioned at an inner portion and an outer portion of the acceptor 200, respectively. To this end, the acceptor 200 may be insert-injection-molded together with the external terminal 400.

Although not illustrated in the drawing, a plurality of external terminals 400 may be formed.

As illustrated in FIG. 2, the internal terminal 500 penetrates through the pump housing 100 and the acceptor 200 to connect the motor and the control substrate 300 to each other. The internal terminal 500 may be formed of a conductor, and may be insert-injection-molded together with the acceptor 200, similar to the external terminal 400. That is, the external terminal 400 and the internal terminal 500 may be fixed into an inner portion of a mold, and be then injection-molded together with the acceptor 200.

When the pump housing 100 and the acceptor 200 are coupled to each other, the internal terminal 500 is inserted into the pump housing 100 and is connected to the stator 113 of the motor, such that the control substrate 300 and the stator 113 may be electrically connected to each other.

Hereinafter, a method of manufacturing an electric water pump according to the present disclosure will be described in detail with reference to the accompanying drawings. Since a method of manufacturing an electric water pump according to the present disclosure to be described below corresponds to a method of manufacturing the electric water pump described above, components denoted by the same names and reference numerals as those of the electric water pump are considered as the same components as those of the electric water pump.

The method of manufacturing an electric water pump according to the present disclosure may include a previous manufacturing step, an assembling step, a control substrate installing step, and a cover installing step. FIGS. 3A to 5 are schematic views after the steps for describing the method of manufacturing an electric water pump according to the present disclosure are performed.

In the previous manufacturing step, the pump housing 100 and the acceptor 200 are manufactured. The acceptor 200 is manufactured in the previous manufacturing step so that the external terminal and the internal terminal penetrate through the acceptor and one ends of the external terminal and the internal terminal are positioned at the outer portion of the acceptor and the other ends thereof are positioned at the inner portion of the acceptor.

The pump housing may be formed of a metal such as aluminum having the high thermal conductivity as described above to serve as the heat sink of the control substrate.

As illustrated in FIG. 2, the external terminal 400 penetrates through the side surface of the acceptor 200, has a rotated '⊏' shape, and may be formed so that one end thereof is positioned at the outer portion (an upper portion) of the acceptor 200 and the other end thereof is positioned at the inner portion of the acceptor 200. Similar to the external terminal 400, the internal terminal 500 penetrates through the acceptor 200 in a vertical direction, and may be formed so that one end thereof is positioned at the outer portion (a lower portion) of the acceptor 200 and the other end thereof is positioned at the inner portion of the acceptor 200.

In the previous manufacturing step, the acceptor 200 may be insert-injection-molded in a state in which the external terminal 400 and the internal terminal 500 are fixed in the mold when the acceptor 200 is injection-molded, in order for the external terminal 400 and the internal terminal 500 to penetrate through the acceptor 200.

Figure 3A:
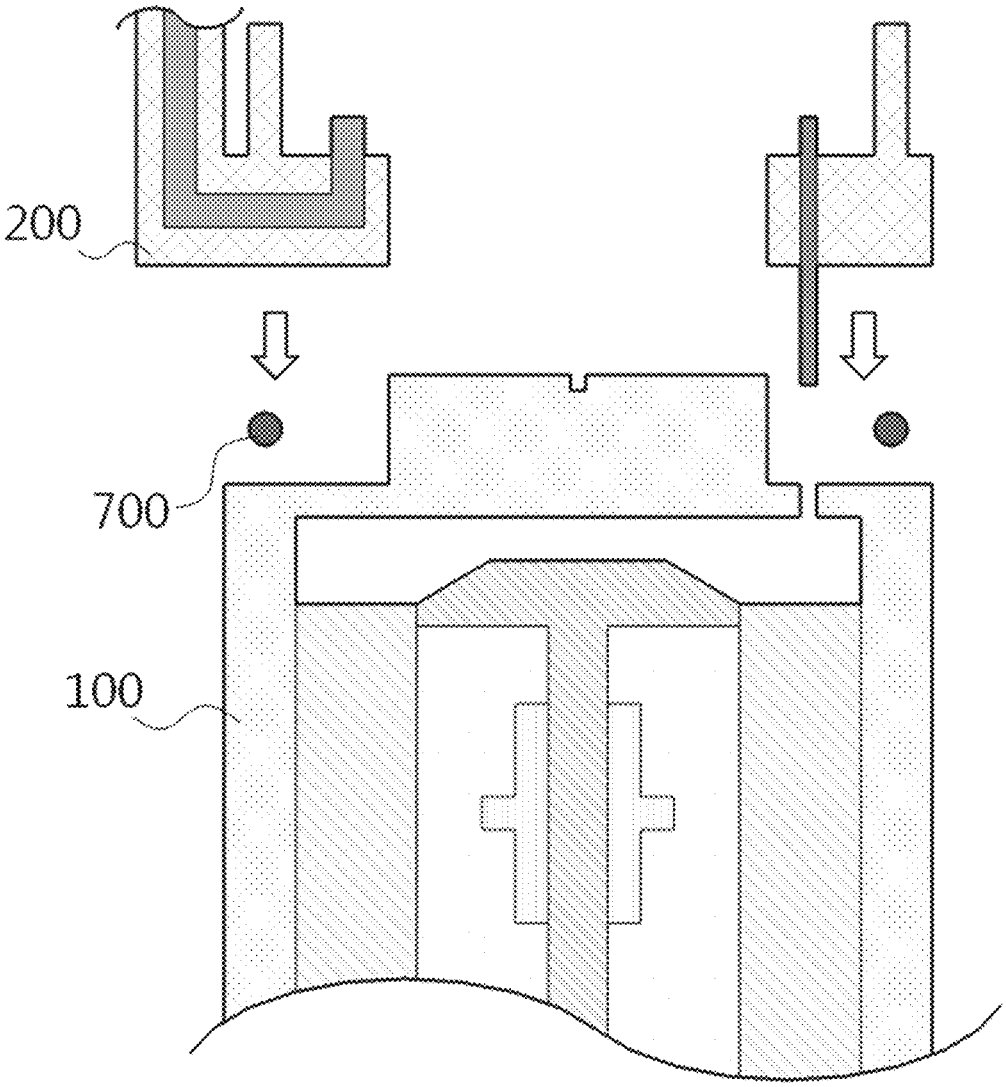
FIGS. 3A and 3B are cross-sectional views after an assembling step according to the present disclosure is performed.
Figure 3B:
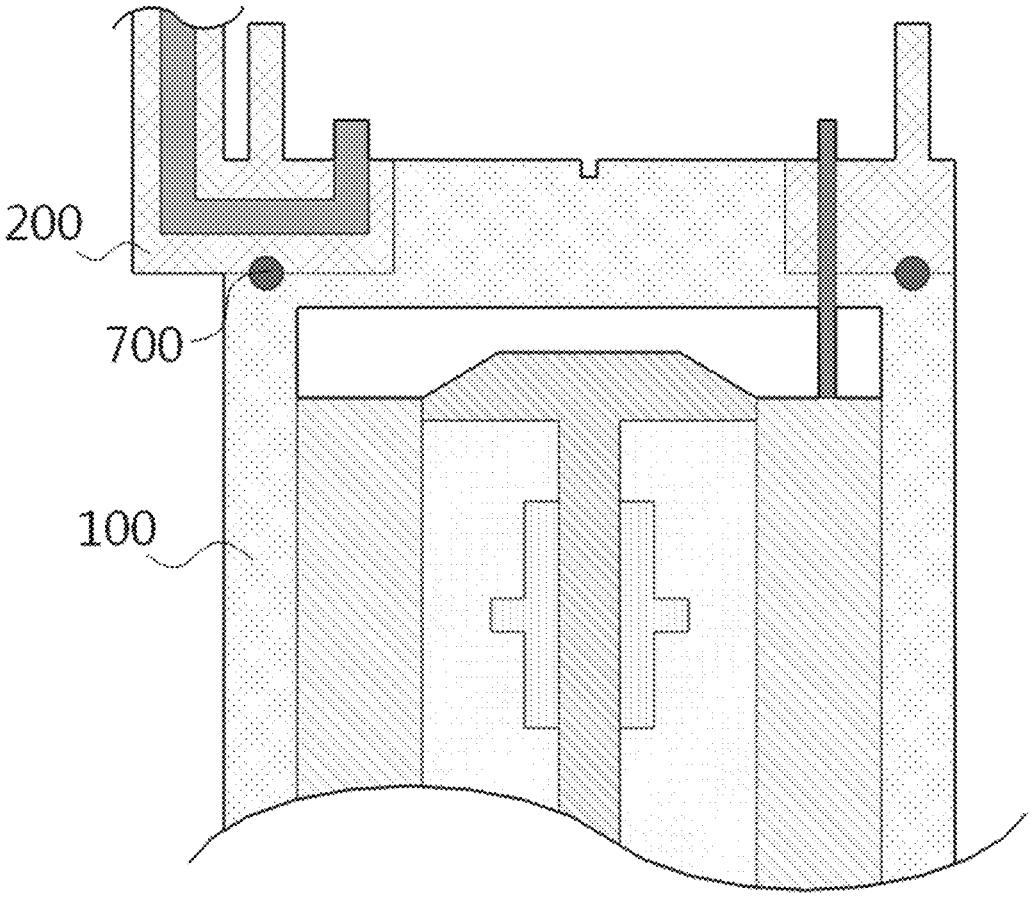

As illustrated in FIGS. 3A and 3B, in the assembling step, components of the electric water pump including the motor are installed in the pump housing 100, the acceptor 200 is assembled to one side of the pump housing 100, and one end of the internal terminal 500 is then connected to the motor. In this case, as illustrated in FIGS. 3A and 3B, the pump housing 100 and the acceptor 200 are coupled to each other in a state in which the O-ring 700 is positioned on coupling surfaces of the pump housing 100 and the acceptor 200 in contact with each other, such that air-tightness of the acceptor 200 may be improved.

The pump housing 100 and the acceptor 200 may be in contact with each other and be then screwed to each other, and positions at which the pump housing 100 and the acceptor 200 are screwed to each other may be outer surfaces of the pump housing 100 and the acceptor 200 in contact with each other.

Figure 4:
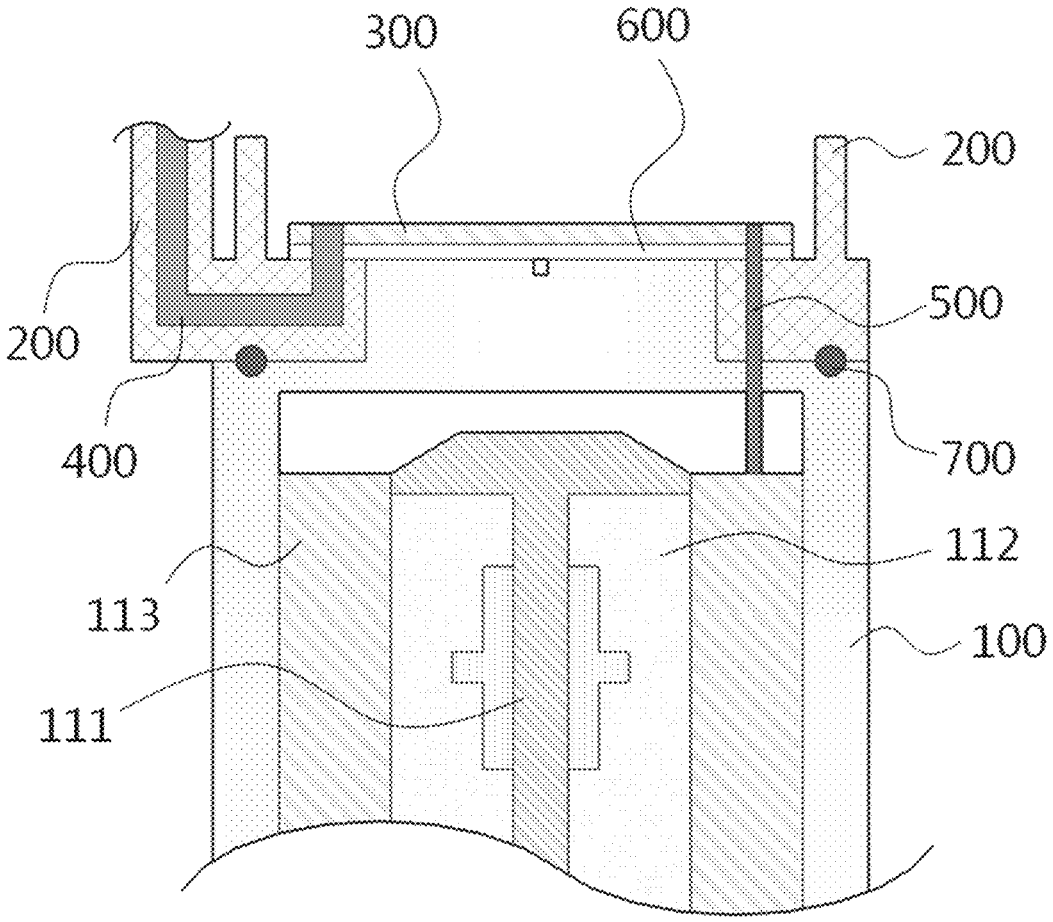
FIG. 4 is a cross-sectional view after a control substrate installing step according to the present disclosure is performed.

As illustrated in FIG. 4, in the control substrate installing step, the control substrate 300 may be installed in the acceptor 200. However, in the control substrate installing step, the control substrate 300 may be installed after the heat transfer portion 600 is installed on an upper surface of the acceptor 200. The control substrate 300 may be installed on the upper surface of the acceptor 200 in a press fitting manner.

In the control substrate installing step, the control substrate 300 may be installed and be electrically connected to the external terminal 400 and the internal terminal 500.

Figure 5:
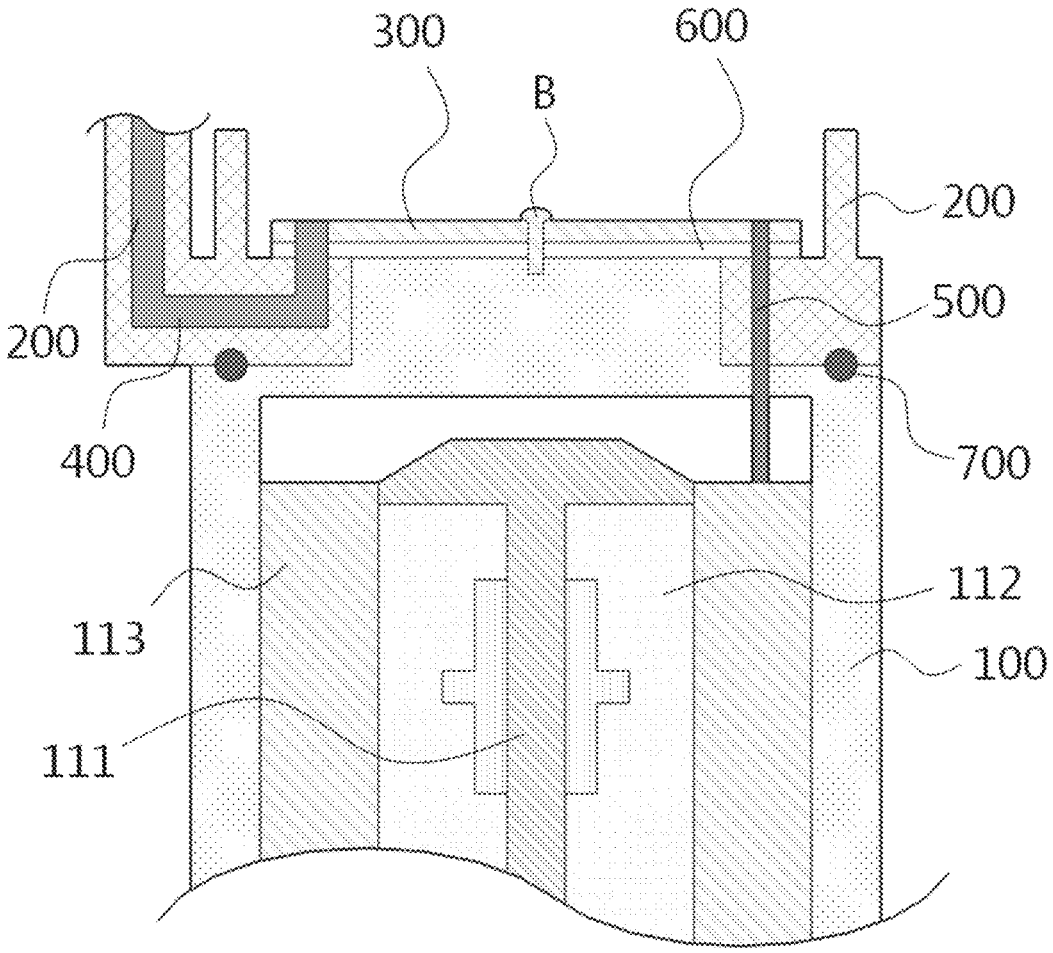
FIG. 5 is a cross-sectional view illustrating a state in which a bolt is bolted to a control substrate according to the present disclosure.

As illustrated in FIG. 5, after the control substrate 300 is installed in the control substrate installing step, the control substrate 300 may be fixed using a bolt B. However, in this case, as illustrated in FIG. 5, the bolt B may penetrate through the control substrate 300 and the heat transfer portion 600, and may be in contact with a circuit connected to a ground (not illustrated) of the control substrate 300 to be resultantly connected to the ground of the control substrate, thereby inducing electrostatic discharge (ESD) that may be introduced from the outside to the control substrate to the ground through the bolt B to prevent a malfunction and a fault of the control substrate 300.

Only a single bolt B is illustrated in FIG. 5, but the present disclosure is not limited thereto. That is, the number of bolts B is may also be plural.

In the cover installing step, a cover 210 is installed to cover the control substrate 300. The cover 210 may be coupled to the acceptor 200 in a laser welding manner or a heat corking manner, but the present disclosure is not limited thereto. The cover 210 may be formed in a prefabricated manner using a coupling structure such as a separate fitting structure between the acceptor 200 and the cover 210.

The electric water pump of which manufacture is completed by performing the cover installing step is illustrated in FIG. 2. In the electric water pump according to the present disclosure as illustrated in FIG. 2, a separate conductor such as a terminal for electrical connection to the control substrate 300 is not formed in the cover 210. Therefore, when a user is to perform debugging or maintenance on the control substrate, it is sufficient to remove the cover 210, such that the electric water pump is easily used. In addition, since the acceptor 200 may be formed together with the external terminal 400 and the internal terminal 500 through the insert-injection-molding, productivity of the electric water pump may be increased.

According to the electric water pump and the method of manufacturing the same according to the present disclosure as described above, the external terminal electrically connecting the external power supply and the control substrate to each other and the internal terminal electrically connecting the control substrate and the motor to each other are integrated with the acceptor through the insert-injection-molding, such that the acceptor may be produced by a single production process and economical efficiency is thus improved.

In addition, according to the present disclosure, a separate electrical conductor such as a terminal is not installed in the cover formed to cover the control substrate. Therefore, when the cover is removed in order to perform the debugging or the maintenance on the control substrate, an additional work is not required, such that when the user uses the electric water pump, convenience is improved.

The present disclosure is not limited to the abovementioned exemplary embodiments, but may be variously applied, and may be variously modified without departing from the gist of the present disclosure claimed in the claims.

| [Detailed Description of Main Elements] | |
|---|---|
| B: bolt | |
| 10: pump case | 20: motor body |
| 30: inlet | 40: outlet |
| 50: shaft | 60: control substrate |
| 70: cover | |
| 100: pump housing | 111: shaft |
| 112: rotor | 113: stator |
| 200: acceptor | 210: cover |
| 300: control substrate | |
| 400: external terminal | |
| 80, 500: internal terminal | |
| 600: heat transfer portion | |
| 700: O-ring | |

The invention claimed is:

1. An electric water pump comprising:

a pump housing accepting a motor therein;

an acceptor having a cylindrical shape of which one side is opened and formed at one side of the pump housing;

a control substrate installed in the acceptor;

an external terminal formed of a conductor and penetrating through the acceptor to electrically connect the control substrate to an external power supply; and an internal terminal formed of a conductor and penetrating through the pump housing and the acceptor to electrically connect the motor and the control substrate to each other, wherein the acceptor, the external terminal, and the internal terminal are integrally manufactured through insert-injection-molding, and one end of the internal terminal is positioned at an outer portion of the acceptor and the other end is positioned at an inner portion of the acceptor, and wherein the acceptor, the external terminal, and the internal terminal are assembled to one side of the pump housing, such that the other end of the internal terminal is connected to the motor.

2. The electric water pump of claim 1, further comprising a heat transfer portion installed between the control substrate and the pump housing.

3. The electric water pump of claim 1, further comprising a cover installed at one side of the acceptor so as to cover the control substrate.

4. A method of manufacturing an electric water pump, comprising:

a previous manufacturing step of manufacturing a pump housing and an acceptor, the acceptor being manufactured so that an external terminal and an internal terminal penetrate through the acceptor, and where ends of the external terminal and the internal terminal are positioned at an outer portion of the acceptor and other ends thereof are positioned at an inner portion of the acceptor, wherein the acceptor, the external terminal, and the internal terminal are integrated through insert-injection-molding;

an assembling step of installing components of the electric water pump including a motor in the pump housing, assembling the acceptor to one side of the pump housing, and connecting the one end of the internal terminal to the motor;

a control substrate installing step of installing a control substrate in the acceptor; and a cover installing step of installing a cover so as to cover the control substrate.

5. The method of manufacturing an electric water pump of claim 4, wherein in the control substrate installing step, the control substrate is installed after a heat transfer portion is installed at one side of the acceptor.

6. The method of manufacturing an electric water pump of claim 4, wherein in the control substrate installing step, the control substrate is installed using press fitting.

7. The method of manufacturing an electric water pump of claim 4, wherein in the control substrate installing step, after the control substrate is installed, the control substrate is screwed so that one end portion of a bolt penetrates through the control substrate and is in contact with the pump housing, and the bolt and a ground of the control substrate are connected to each other.

* * * * *